US005556123A

United States Patent [19]

Fournier

[11] Patent Number: 5,556,123

[45] Date of Patent: Sep. 17, 1996

[54] SNOWBOARD BINDING WITH COMPENSATING PLATE

[76] Inventor: Louis Fournier, 11 359 ave royale, Beauport, Québec, Canada, G0A 1E0

[21] Appl. No.: 241,479

[22] Filed: May 12, 1994

[51] Int. Cl.[6] ..... A63C 9/00

[52] U.S. Cl. ..... 280/607; 280/619; 280/633; 280/14.2

[58] Field of Search ..... 280/617, 620, 280/621, 622, 625, 626, 633, 634, 11.36, 14.2, 607, 618; 441/70; 36/117, 118, 119, 120

[56] References Cited

U.S. PATENT DOCUMENTS

| | | | |
|---|---|---|---|
| 4,937,952 | 7/1990 | Olivieri | 36/119 |
| 4,949,479 | 8/1990 | Ottieri | 36/117 |
| 4,969,278 | 11/1990 | Ottieri | 36/117 |
| 4,979,760 | 12/1990 | Derrah | 280/607 |
| 4,984,375 | 1/1991 | Bonnet | 36/117 |
| 5,188,386 | 2/1993 | Schweizer | 280/14.2 |
| 5,261,689 | 11/1993 | Carpenter | 280/618 |
| 5,354,088 | 10/1994 | Vetter et al. | 280/14.2 |

FOREIGN PATENT DOCUMENTS

| | | | |
|---|---|---|---|
| 1154799 | 4/1983 | Canada | 280/618 |
| 2652753 | 12/1991 | France | 280/618 |
| 4061211862 | 5/1994 | Japan | 280/14.2 |

*Primary Examiner*—Anne Marie Boehler

[57] ABSTRACT

A snowboard boot binding comprising a base adapted to receive a boot, an in-step pad adapted to cover the top of the boot, a rear support adapted to cover a heel and the back of the boot, the rear support being pivotedly mounted at the base. The in-step pad is attached to the base via tension cables passing through the sides of the base, coming out under the base below a pivot point and being attached to the rear support and progressing longitudinally along the rear support. The rear support is maintained in a vertical position by a spring loaded lever, which when pulled back, provides space to insert the boot and most importantly releases the tension in the cables, and which allows the easy insertion of the boot. Bringing the rear support back to its original position reestablishes the tension in the cables. The boot is thus firmly held in place by the combined effects of the pressure provided by the in-step pad and the rear support. For storage the rear support can be folded over the base, to save space.

6 Claims, 7 Drawing Sheets

SNOWBOARD BINDING WITH COMPENSATING PLATE

BACKGROUND OF THE INVENTION

1. Field of Invention

This invention belongs to the family of snowboard binding, more particulary to a system of snowboard binding where the entry and exit are made easy without losing the retention force of the binding on the foot and to which a reinforcement plate is added and adapted to improve the maneuverability and the shearing force on the snowboard edge.

2. Description of the Prior Art

The prior art shows a variety of binding systems intended to maintain a foot on a snowboard. Such a system is illustrated in FR 2 652 753 Salomon where a device with special clips is adapted to receive a standard ski boot. Even though the system allows anybody possessing a pair of ski boots to use a snowboard, this also means that someone who does not possess ski boots has to add the price of the ski boots to the price of the bindings and the snowboard. Furthermore, the adept of "free style" snowboarding finds the ski boot inadequate for the maximal use of the snowboard capacity, the boot restraining the ankle movement too much.

A solution to these disadvantages is illustrated in CAN 1,154,799 Bataille 83/10/04 wherein a binding comprising a base plate on which are placed two articulated support plates, one supporting the back of a boot and the other covering the top of the boot. The two support plates are adapted from a mechanism that is released by means of a ski pole and adapted to make the plates bend to the inside thus restraining the boot. The reverse operation frees the boot. The system provides a good support but the great number of components used in this system makes it propitious to wear. Hence, the need of a ski pole to clench the binding renders the latter unfunctional for snowboarding, a sport where ski poles are not used.

U.S. Pat. No. 5,261,689 Carpenter November 1993 illustrates another type of binding comprising a base on which a vertical support is mounted in a way as to fold up on the base. Two straps anchored on each side of the base, pass on top of a boot in order to maintain it in place. Even though this system is simple and holds the boot well, the straps have a tendency to slacken and break with wear. Moreover the subsequent entry and exit of the boot from this binding constitutes a fastidious operation because the straps must be slackened considerably to let the boot loose and then redo the adjustment completely.

U.S. Pat. No. 4,979,760 Derrah 12 Dec. 1990 illustrates a similar binding as Carpenter's where the two strap combination is replaced by a unique strap on which is adapted a pad covering the top of a boot and distributes the tightening force onto the boot. The insertion and the removal of the boot remains a difficult task, the principle being the same as Carpenter's. Finally the fact that only one strap does the tightening renders it more prone to breakage.

Another problem developed at the same time as snowboarding grew. The weight transfer of a person on the snowboard displaces the resultant foot weight application and this, along the longitudinal axis of the person. This results principally in reducing the maneuvering quality of the snowboard.

Also, when the user has to come to a sudden stop and he encounters a hard surface, an important shearing appears on the snowboard edge, more precisely between the binding and the edge in the breaking axis. This shearing frequently causes snowboard damages, rendering it unusable.

A device presently known is a vibration absorption plate available for alpine skis in part to dampen shocks perpendicular to the ski plane. The device is relatively heavy and its efficiency depends on the use of exotic and expensive materials. No adaptation of this plate is presently available for snowboards.

Objects and Advantages

The first objective of the present invention is to provide a simple and sturdy binding comprising a minimum number of components and that can be used with most types of boots.

A second objective is to provide a binding in which the entry and the removal of the boot is an easy and fast task needing little or no subsequent adjustment.

A third objective is to provide a binding whose prolonged and intensive use does not generate a slackness or a break in the means of tightening.

A fourth objective is to provide a binding adaptable to a number of boot sizes and adaptable to all types of snowboards.

A fifth objective is to provide a binding that folds on itself for an easy storage.

To remedy to these maneuverability and snowboard breaking problems, the invention has a series of additional objectives including the one to provide a plate located between the binding and the snowboard that protects the snowboard from side breaking impacts and whose shape compensates for the weight shifting that causes a loss in maneuverability.

A seventh objective is to provide a plate that protects the snowboard from the damages occurring as sudden breaking is applied on a hard surface.

An eighth objective is to provide a compensation plate that can be installed under other bindings than the invention.

BRIEF DESCRIPTION OF THE DRAWINGS

The present invention will be further understood from the following description with reference to the drawings in which.

DESCRIPTION OF THE PREFERRED EMBODIMENT

Figure 1:
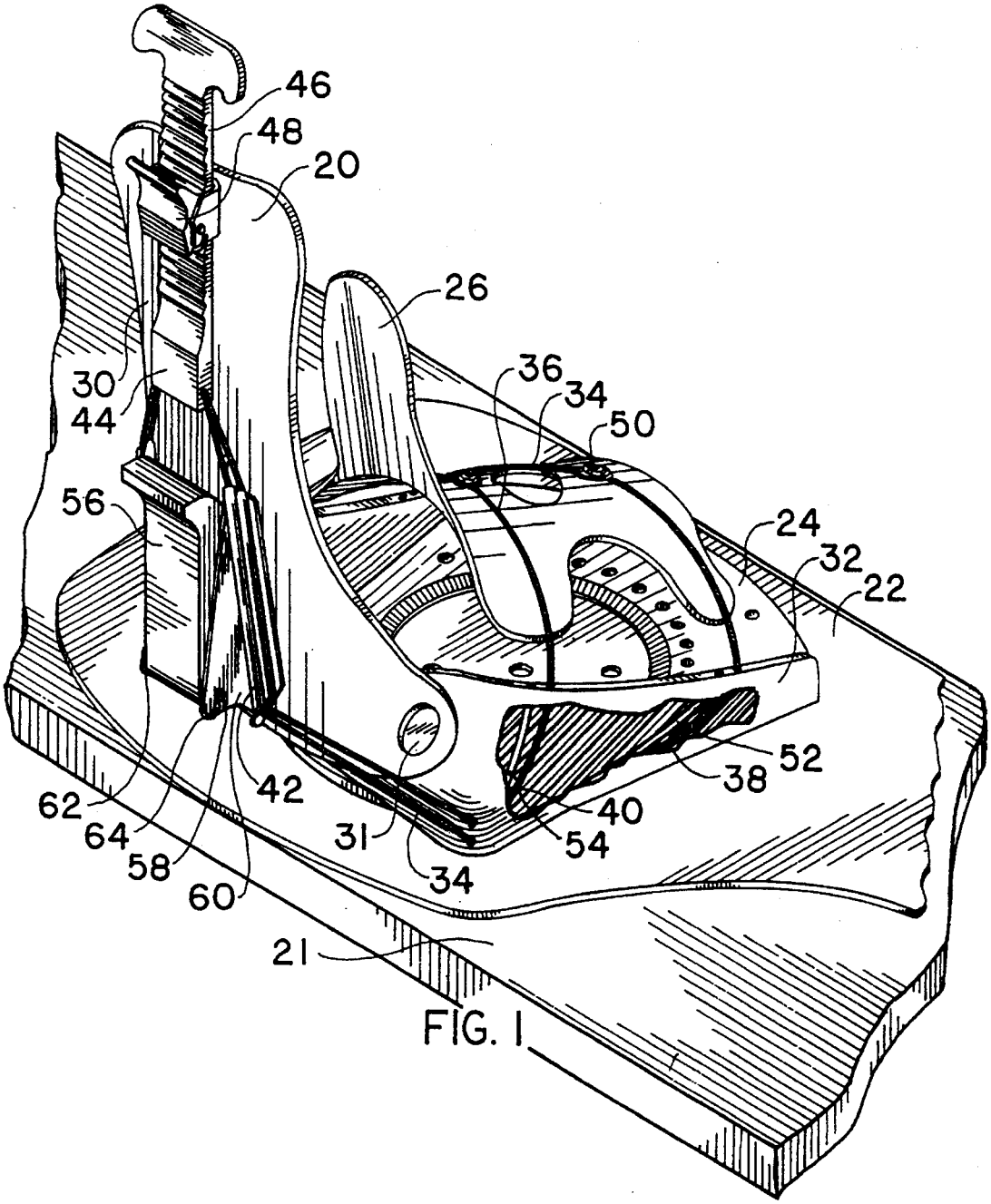
FIG. 1 is a perspective view of a binding on a compensation plate.
Figure 2:
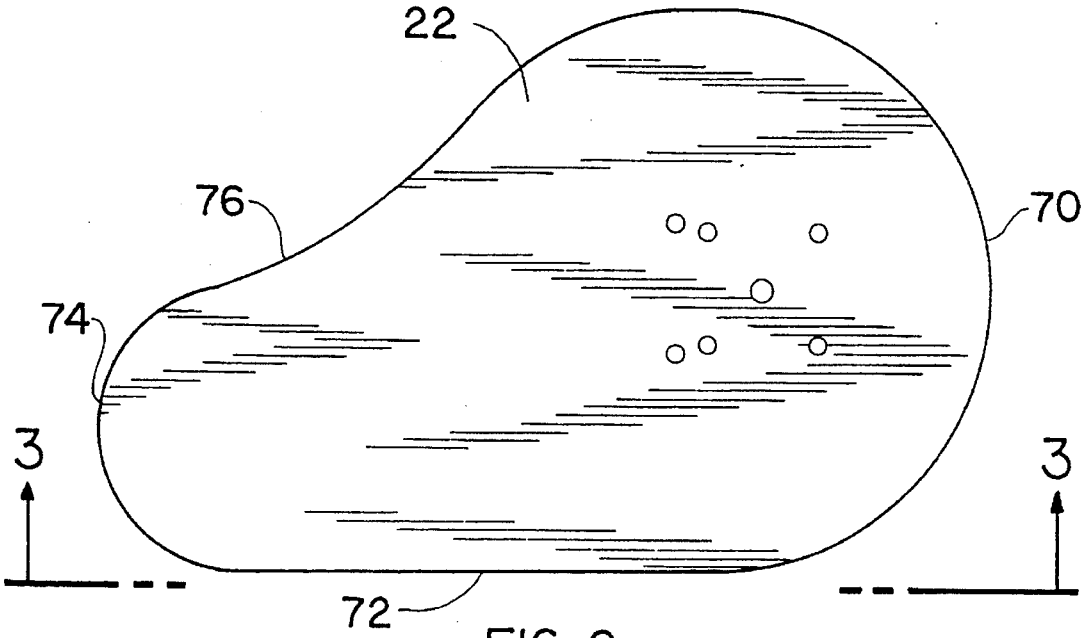
FIG. 2 is a bottom view of the compensation plate.
Figure 3:
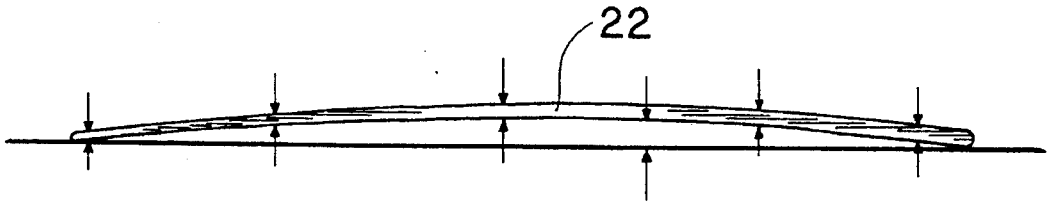
FIG. 3 is a profile view of the compensation plate.
Figure 8:
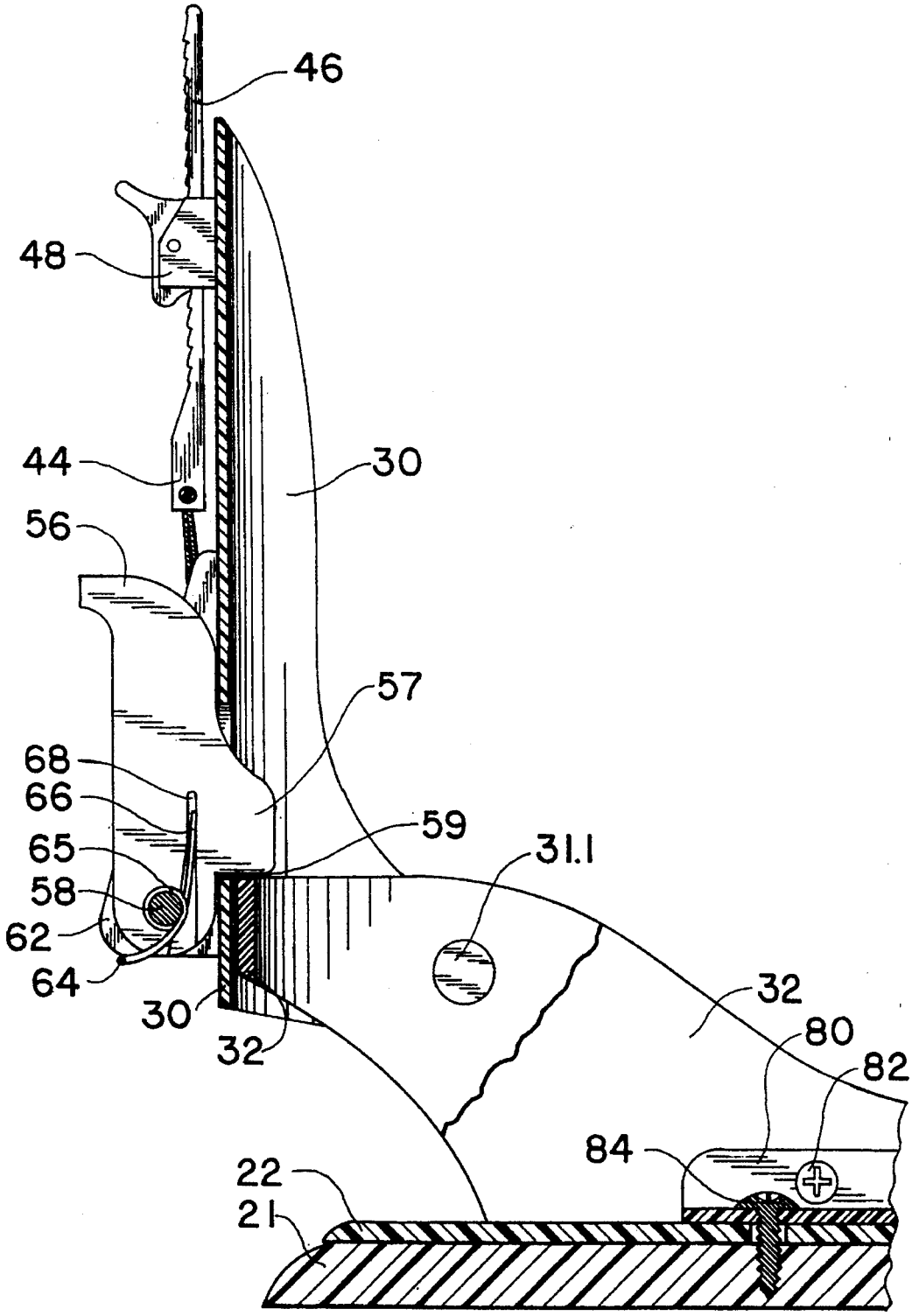
FIG. 8 is a cut lateral view of a variation of the binding.

The preferred embodiment of the invention is illustrated in FIG. 1 where the same characterizing elements are identified by the same numbers and where one can see a binding 20 for a snowboard 21 placed on a compensation plate 22. The binding comprises a base 24 with a fastening system of some kind on the snowboard and which also fastens the compensation plate, a long in-step pad 26 which can be replaced by a short in-step pad 28—FIG. 8—, a rear vertical support 30 articulated on a pivot 31 and its equivalent on the opposite side. The base comprises a contour wall 32 in the back of which the rear vertical support is articulated. The long in-step pad 26 is attached to the base by a pair of cables 34 and 36. The cables pass through front 38 and back 40 channels which are bored in the contour wall 32. The cables then pass in a pair of tubes 42 placed in the bottom half of the sides of the rear vertical support 30 to then pass through a, pierced bulge 44 at the lower extremity of a notched tongue. The cables then pass through a pair of tubes and through channels placed on the opposite side of the binding 20, the tubes and channels being identical and symmetrical with regards to the elements 38, 40, 42. The notched tongue 46 is attached at the top of the rear vertical support 30 with the help of a small fastener 48 allowing a linear ratchet movement toward the top, or a complete loosening of the tongue toward the bottom. The ends of front cable 34 are solidly pinched by tightening bolts 50—FIG. 9B—on the top of the in-step pad 26 and similarly for the ends of rear cable 36. Two additional cable entries 52 and 54 are placed slightly in retreat of the channels 38 and 40 and communicate with the latter, this to allow the in-step pad to come closer for boots of small size. The same arrangement is repeated on the opposite side of the binding. The vertical back support 30 is refrained from any movement toward the back by a blocking lever 56 articulated around a pivot axis 58 on two supports 60 and 62. The pair of tubes 42 are mounted on supports 60 and their counterpart support 62. The blocking lever possesses a blocking finger 57—FIG. 8—that passes through a hole in the back support and comes to rest on the superior edge of the back part of contour wall 32. The lever is held in place by a torsion spring 64. The binding is anchored to the plate 22—FIG. 2—having a generally circular portion 70, a generally straight portion 72, a second generally circular portion 74, a curved section 76 having its apex toward the interior of the plate and meeting the circular section 70. The plate profile—FIG. 3—possesses a 3° positive camber. The plate should be constructed of a very stiff material, like fiberglass, carbon fibre or any other member of the composite material family which offers stiffness and elasticity.

In another embodiment of the invention a force transmitting compensation plate 23 may have a generally trapezoidal shape. Moreover the binding may be modified as to eliminate the base 24 and to place the fastening means on the external sides of the contour wall 32. In this manner the boot is in direct contact with the snowboard, allowing a more direct "feel" of the snowboard.

Holding means such as angle irons are placed on the external sides of contour wall 32. An example is illustrated on—FIG. 8—wherein an angle iron 80 connects the sides of the contour wall; 32 to board 21 by means of screws 82 and 84.

Operation of the Invention

Figure 4A:
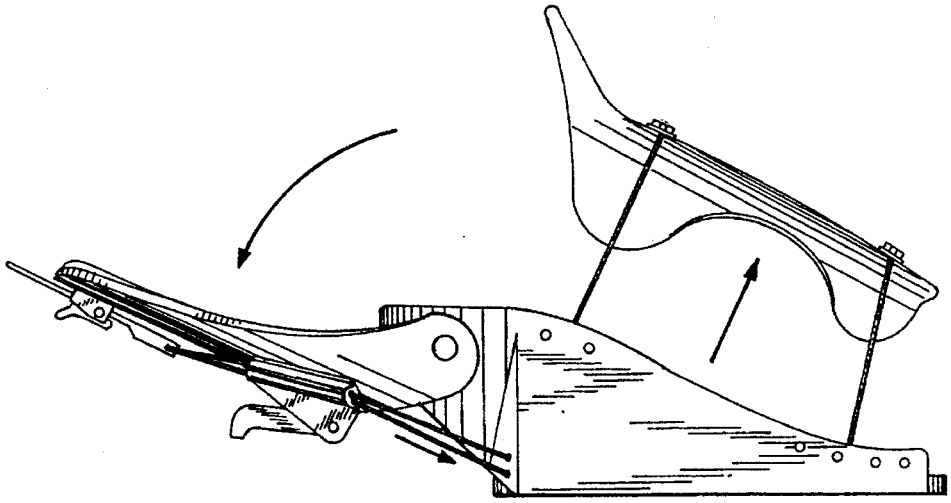
FIG. 4A is a side view of the binding in an "open" position.

Before inserting one's boot into the binding—FIG. 4A—the utilizer pushes blocking lever 56 toward the back, which disengages blocking finger 57 from its position on the higher edge 59 of the contour wall 32 and thus permits rear vertical support 30 to be displaced towards the back—FIG. 4A—and thereby releasing tension in the cables and therefore the pressure exerted by the in-step pad 26. The open space liberated by the backward displacement of the higher part of the rear vertical support 30 which pivots around the pivot axis 31, causes the forward displacement of the apex of the lower part of the rear vertical support 30, which contains the cable, thereby releasing the cables allowing the forward displacing of the in-step pad, thereby leaving a wide open space for the easy insertion of a boot into the binding.

Figure 4B:
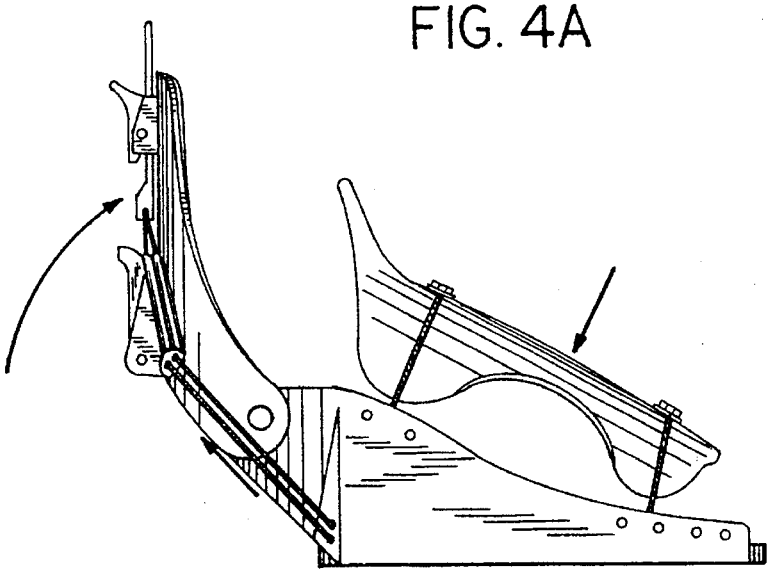
FIG. 4B is a side view of the binding in an "in use" position.
Figure 4C:
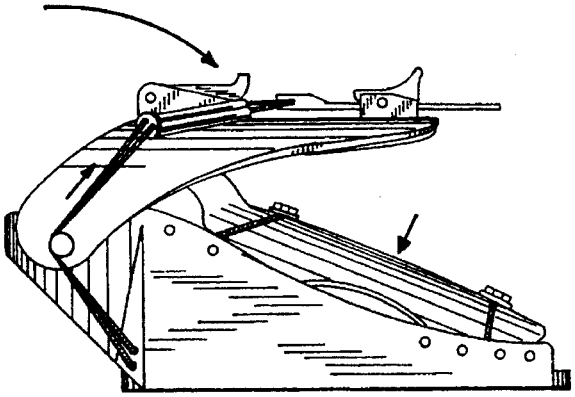
FIG. 4C is a side view of the binding in a "folded" position.
Figure 5:
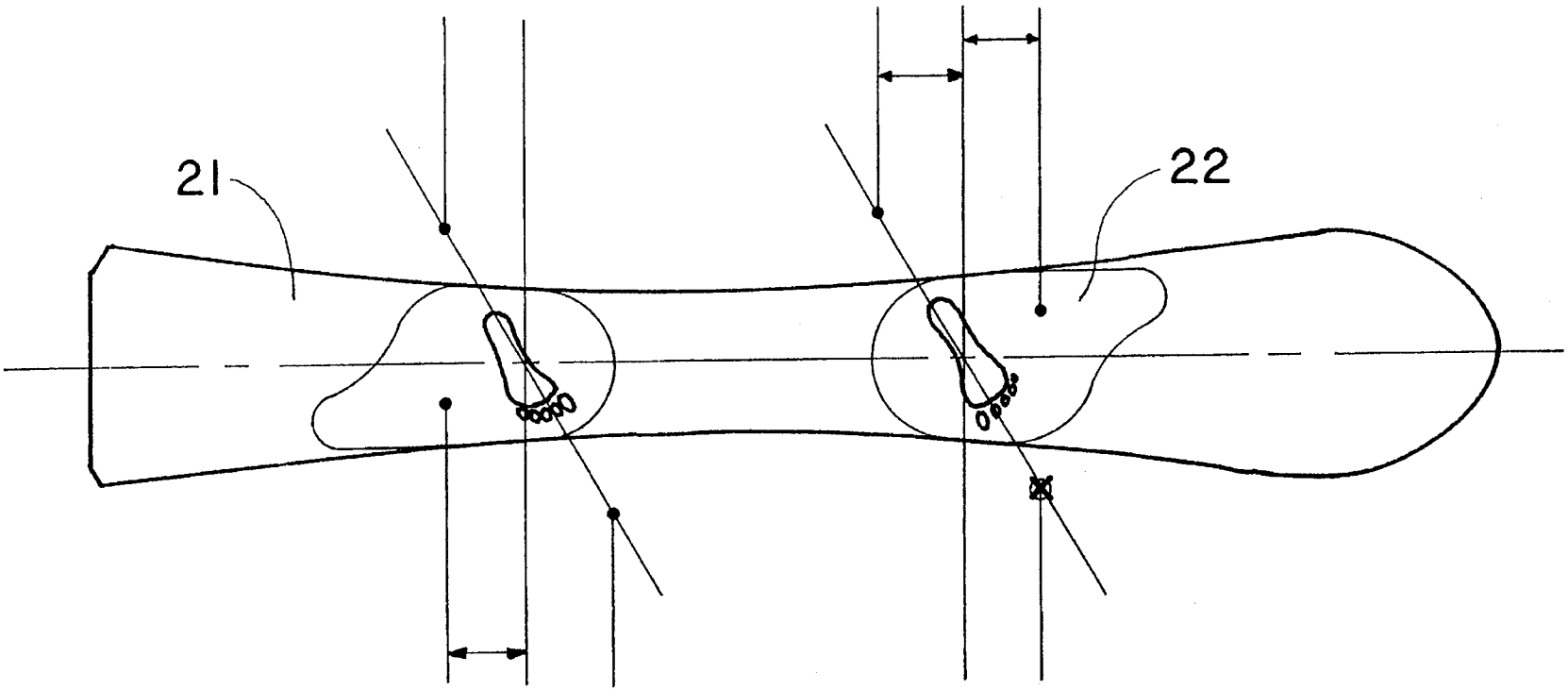
FIG. 5 is a schematic view of a snowboard top with the compensation plate.

To close—FIG. 4B—the user brings rear vertical support 30 vertically. This by lever action around the pivot 31 allows tension back into the cables, restoring in-step pad 26 toward the boot and therefore holding the boot firmly. Blocking lever 56—FIG. 1—pushed by spring 64 returns to its original position and blocks the rear vertical support 30 in a vertical position. The cable tension may be adjusted with the help of notched tongue 46 and fastener 48. For storage—FIG. 4C—, the rear vertical support 30 is simply pulled down towards the front, which reduces the space needed to store it.

The compensation plates are perforated more or less depending on the use of the binding on the snowboard 21.

The plate compensates, by its shape and camber, the transmission of force by the boot to the side of the snowboard by generating a reaction force on the opposite side, therefore distributing the weight of the boot evenly on the general surface of the boot.

Figure 6:
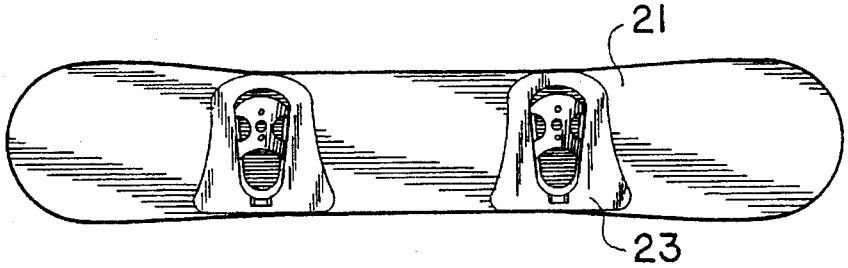
FIG. 6 is a top view of a "free style" snowboard with a binding and compensation plate variation.
Figure 7:
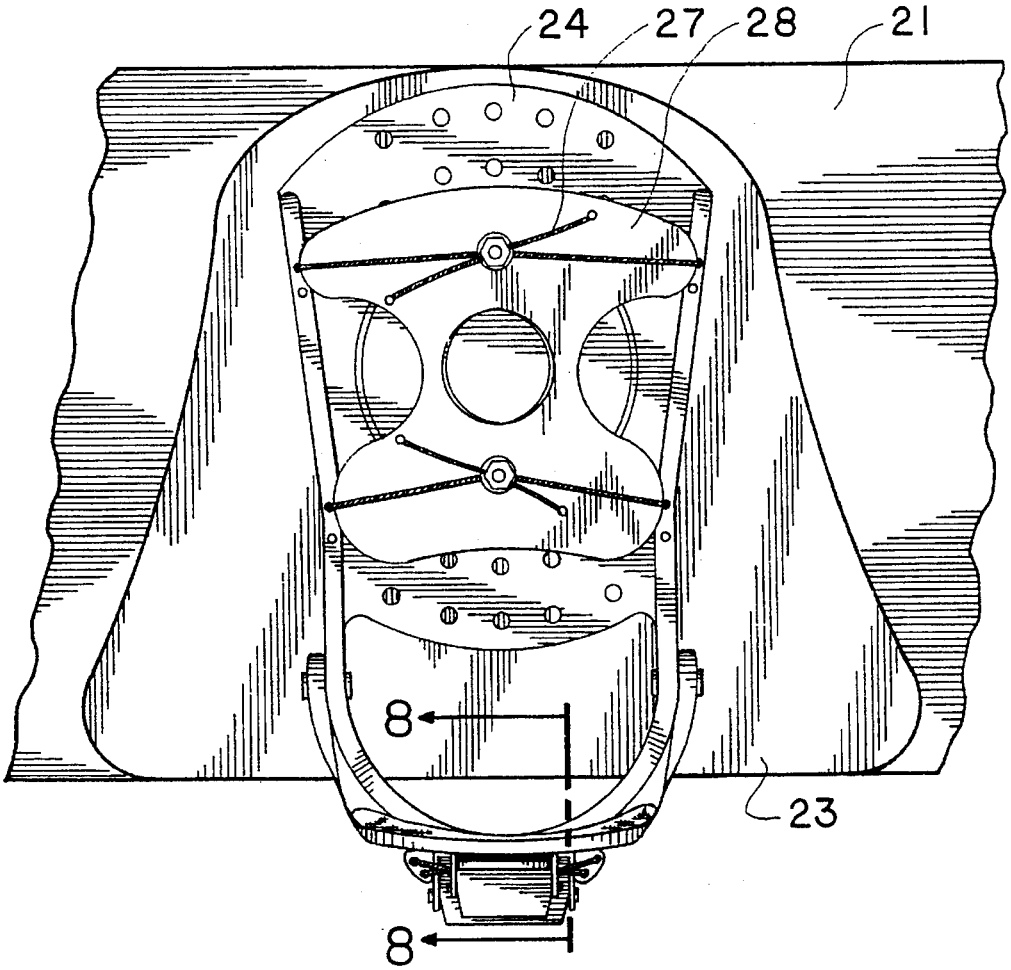
FIG. 7 is an enlarged view of the variation of FIG. 6.

The transmission of the force is done differently depending on the orientation of the boot relatively to the longitudinal axis of the snowboard. For the boot orientation angles ranging from 0° to 25°, that one finds when practicing "free style", the trapezoidal compensation plate—FIG. 6—is utilized. For angles ranging from 25° to 55°, which one finds in "alpine style" snowboarding, an ovoid compensation plate is more adequate because of its extension.

Summary, Ramifications, and Scope

Figure 9A:
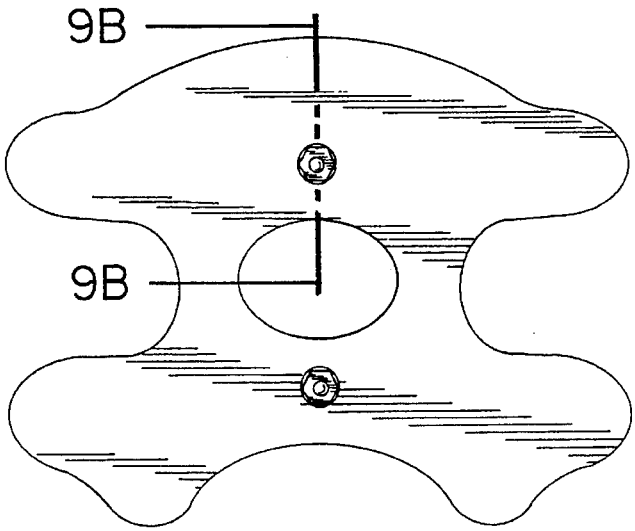
FIG. 9A is a top view of a short in-step pad.
Figure 9B:
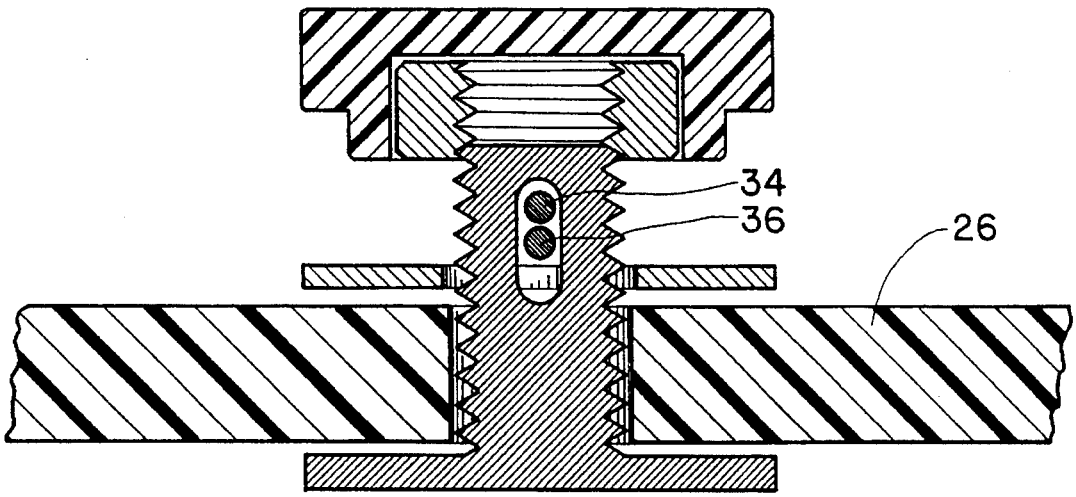
FIG. 9B is a partial cross-section of a cable fastening and tightening means.

A boot binding system for a snowboard comprising:

a contour wall outlining a boot and comprising a rear, a centre and a front section, the rear adapted to receive a heel, and defining a "U" with a web and two wings, when seen from above, the wings of the "U" comprising two pivot points facing each other, a generally horizontal pad adapted to cover the centre over the boot to maintain the boot within the confines of the contour wall;

a leg support element 30 pivotedly attached to the rear section of the contour wall 32 at pivot points 31, the leg support element 30 adapted to be moved circumferentially around pivots 31 from a first generally horizontal position—FIG. 4A—allowing insertion of a boot above the leg support element 30 and behind the long in-step pad 26 on a short in-step pad 28—FIG. 9A—, up to a second generally vertical position,—FIG. 4B—the boot being enclosed between the support element 30, the in-step pad 26—FIG. 4A—and the contour wall 32, cable means joining support element 30 to the in-step pad 26, passing circumferentially substantially under pivot 31, and comprising at least one cable guide placed on contour wall substantially lower than the pivot point 31. A mechanism further comprising a force transmitting compensation plate adapted to be installed on the surface of a snowboard and under the sole of a boot, the plate possessing a positive camber of 1° to 5°. A mechanism wherein the plate is built of a hard material, with some elasticity, such as aluminum and fiberglass.

Other embodiments are possible and limited only by the scope of the appended Claims.

Parts list

| | | | |
|---|---|---|---|
| 20. | binding | 60. | right support |
| 21. | snowboard | 62. | left support |
| 22. | ovoid compensation plate | 64. | torsion spring |
| 23. | trapezoidal compensation plate | 70. | generally circular portion |
| 24. | base | 72. | generally straight portion |
| 26. | long in-step pad | 74. | second small, generally circular, portion |
| 28. | short in-step pad | 76. | curved section |
| 30. | rear vertical support | 80. | angle iron |
| 31. | pivot | 82. | screw |
| 31.1 | left side pivot | 84. | screw |
| 32. | contour wall | | |
| 34. | cable | | |
| 36. | cable | | |
| 38. | front channel | | |
| 40. | back channel | | |
| 42. | pair of tubes | | |
| 44. | pierced bulge | | |
| 46. | notched tongue | | |
| 48. | small fastener | | |
| 50. | tightening screw | | |
| 52. | supplementary front cable entry | | |
| 54. | supplementary rear cable entry | | |
| 56. | blocking lever | | |
| 57. | blocking finger | | |
| 58. | pivot axis | | |
| 59. | superior edge | | |

I claim:

1. A boot binding system for a snowboard comprising:

a contour wall outlining a boot and comprising a rear, a centre and a front section, said rear section adapted to receive a heel, said rear section defining a "U" comprising a web and two wings, when seen from above, said wings of said "U" comprising two pivot points facing each other, a generally horizontal pad adapted to cover said centre over said boot to maintain said boot within the confines of said contour wall;

a leg support element mounted so as to support the back of a user's leg and pivotedly attached to said rear section in said pivot points, said leg support element adapted to be moved circumferentially on said pivot points from a first generally horizontal position allowing insertion of the boot above said leg support element and behind said pad, up to a second generally vertical position, the boot being enclosed between said leg support element, said pad and said contour wall, a cable joining said support element to said pad, adapted for passing circumferentially around said pivot points, said cable comprising at least one cable guide placed on said contour wall and substantially lower than said pivot points, said cable causing the tightening of said pad against said enclosed boot when said leg support element is moved to said generally vertical position.

2. A system as defined in claim 1 wherein said rear section comprises a progressively elevated part starting at a first apex corresponding to a meeting point between said centre section and said rear section and finishing at said web of said rear section, thereby defining an open wedge space allowing the insertion of a boot when said leg support element is in a horizontal position.

3. A system as defined in claim 2 wherein said cable guide is a first cable guide placed at said apex.

4. A system as defined in claim 3 further comprising a second cable guide placed in an upper part of said contour wall and adapted to direct said cable towards a working position on, top of said in-step pad.

5. A system as defined in claim 4 wherein said first and second cable guides are first channels directed towards said working position.

6. A system as defined in claim 5 further comprising second channels adapted to provide a second working position of said in-step pad.

* * * * *